United States Patent [19]

Dunham et al.

[11] 4,074,977

[45] Feb. 21, 1978

[54] CHARCOAL BRIQUET SYSTEM

[76] Inventors: Philip N. Dunham, Fortune Rocks Biddeford, Maine 04005; John N. Tillyer; Center Street, Armand Martin, Simpson Road, both of Saco, all of Maine 04072

[21] Appl. No.: 695,007

[22] Filed: June 11, 1976

[51] Int. Cl.[2] ..... C10L 11/00

[52] U.S. Cl. ..... 44/38; 44/40; 44/41

[58] Field of Search ..... 44/2, 6, 38, 34, 40, 44/41, 11–13

[56] References Cited

U.S. PATENT DOCUMENTS

| | | | |
|---|---|---|---|
| 1,366,258 | 1/1921 | Hager | 44/40 |
| 2,007,694 | 7/1935 | Rutherford | 44/41 |
| 2,094,661 | 10/1937 | Macleay et al. | 44/41 |
| 2,842,431 | 7/1958 | Robertson | 44/6 X |
| 3,367,757 | 2/1968 | Church | 44/38 |
| 3,374,070 | 3/1968 | Davis | 44/6 |

*Primary Examiner*—Carl F. Dees
*Attorney, Agent, or Firm*—Morse, Altman, Oates & Bello

[57] ABSTRACT

An easily ignitable charcoal briquet system is provided for use especially in making small, outdoor cooking fires. The system includes wax-impregnated charcoal briquets in combination with starting pads of wax-impregnated paper or the like. The briquets are impregnated with a hot wax in a two-stage operation to produce a charcoal having two strata of wax impregnated below the surface of the briquets, which enhances ignition and burning characteristics of the briquets. The starting pads preferably are of non-woven paper material having uncoated corners, a light coating of wax along the outer margins thereof, a heavy coating of wax about an inner border thereof and an uncoated central portion. Wax impregnated briquets are piled in the uncoated center portion of the pad, which is ignited by lighting the uncoated corners thereof. The edges of the pad may be corrugated to facilitate ventilation.

8 Claims, 7 Drawing Figures

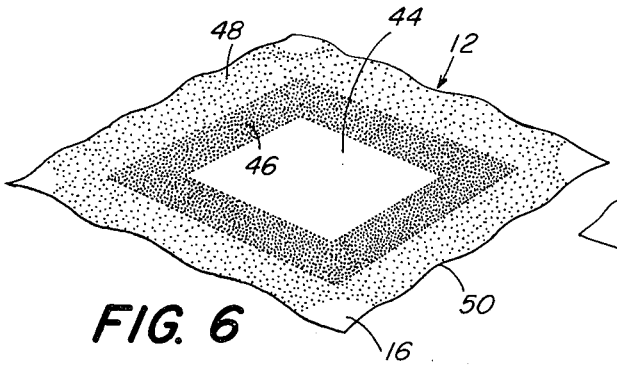
FIG. 6
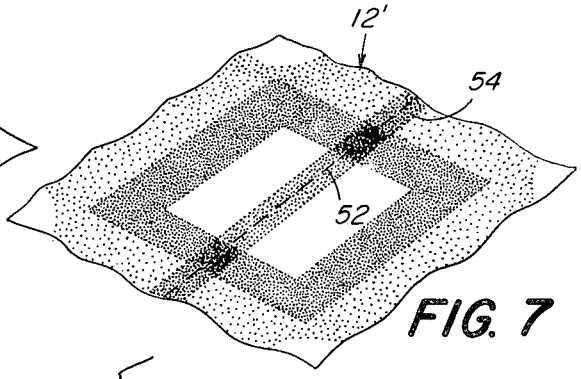
FIG. 7
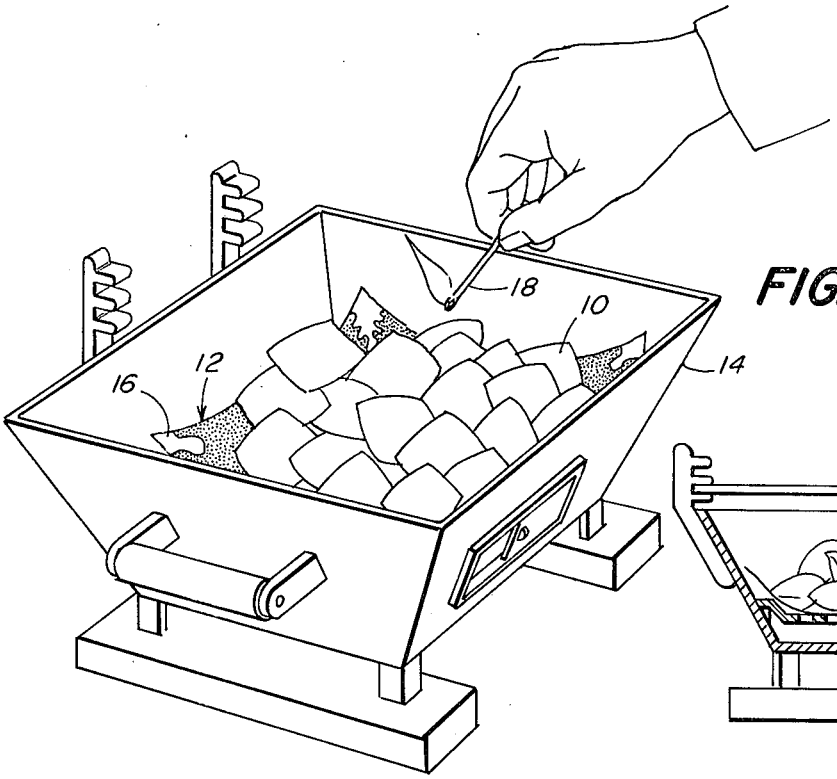
FIG. 1
FIG. 2
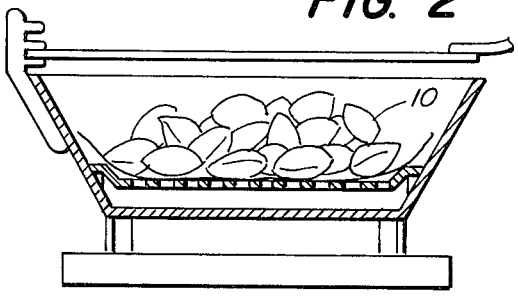
FIG. 3
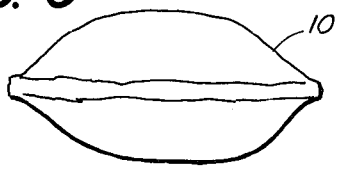
FIG. 4
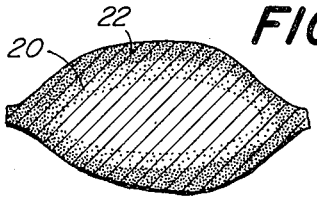
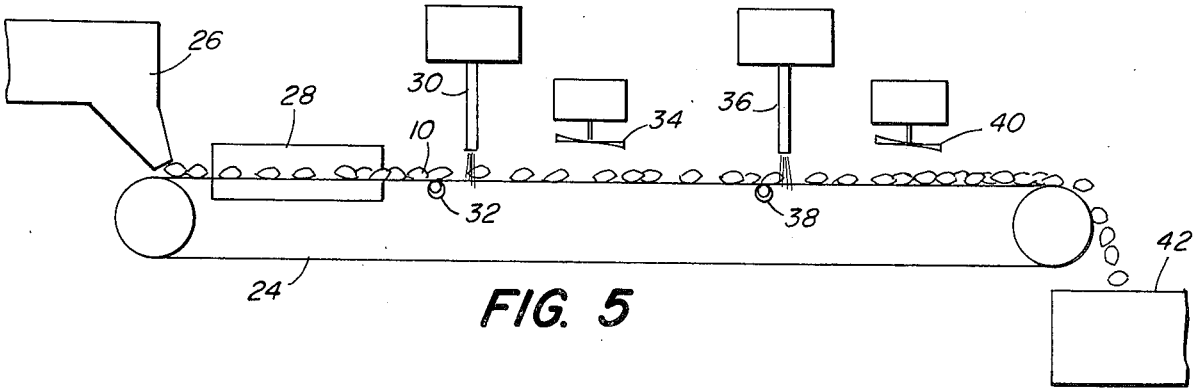
FIG. 5

CHARCOAL BRIQUET SYSTEM

BACKGROUND OF THE INVENTION

1. Field of the Invention

This invention relates generally to wax-impregnated charcoal briquets and their manufacture, and more particularly is directed towards a new and improved charcoal briquet system that is easily ignited without the use of lighter fluid.

2. Description of the Prior Art

Conventional charcoal briquets are ignited normally by dowsing the charcoal with lighter fluid, allowing the fluid to soak into the briquets an then igniting the pile of briquets with a match. Once ignited, the fluid must burn away and the charcoal must be allowed to smolder to a point where the charcoals are hot enough to provide sufficient heat for cooking. The procedure is generally rather time consuming, and if there is any sort of wind, it is quite difficult to start, particularly where the fire is in the open and without shelter. Also, in some instances, if the charcoals are slow to heat up, a person will pour on additional amounts of starter fluid in an attempt to encourage the fire. This is an extremely dangerous procedure and many people are severely burned each year from uncontrolled fires and explosions resulting from this practice.

While it has been suggested to improve the ignitability of charcoal briquets by precoating them with different materials, such as wax, or the like, none of these have been entirely satisfactory from the standpoint of ease of ignition, low smoke characteristics, shelf life, safety, and other factors. Accordingly, it is an object of the present invention to provide improvements in the charcoal briquets. Another object of this invention is to provide a charcoal briquet system that is easily ignitable even in wind. A further object of this invention is to provide a novel method for producing charcoal briquets of superior ignition and burning characteristics.

SUMMARY OF THE INVENTION

This invention features an easily ignitable charcoal briquet system comprising wax-impregnated charcoal briquets in combination with starting pads of paper selectively coated with wax. The wax-impregnated briquets are placed in the center of the pad and the pad is ignited. The wax pattern on the pad causes flames to surround the pile of briquets, uniformly heating the briquets on all sides so that the briquets are brought up to the proper temperature for self-sustained smoldering. The briquets are impregnated with two strata of wax produced by double dipping the briquets at an elevated temperature into molten wax.

BRIEF DESCRIPTION OF THE DRAWINGS

FIG. 1 is a view in perspective of a charcoal briquet system made according to the invention and ready for use, FIG. 2 is a sectional view in side elevation of the FIG. 1 system, FIG. 3 is a view in side elevation of a charcoal briquet made according to the invention, FIG. 4 is a sectional view in side elevation of the FIG. 3 briquet, FIG. 5 is a view in side elevation, somewhat schematic, of a system for mass producing briquets according to the invention, FIG. 6 is a perspective view of a starting pad made according to the invention, and, FIG. 7 is a view similar to FIG. 6 but showing a modification thereof.

DETAILED DESCRIPTION OF THE PREFERRED EMBODIMENTS

Referring now to the drawings, the easily ignitable briquet system, according to the invention, is comprised of wax-impregnated briquets 10 in combination with selectively wax coated starting pads 12 on which the briquets are piled in preparation for starting a fire of the briquets. Typically, the pile of briquets 10 and a starting pad 12 are placed in a suitable holder, such as a hibachi grill 14, in such a manner that the briquets are piled in the center of the pad with the margins of the pad uncovered. The fire is started by lighting one of the corners 16 with a match 18, or the like, so that the pad will burn and surround the pile of briquets on all sides with fire, thereby causing them to ignite. The pad is selectively coated with wax and is easily ignitable by a match even in the wind. Once the pad is ignited, it burns evenly and strongly for a time sufficient to properly ignite the briquets.

Each of the briquets, which may be of a standard size, typically approximately 2 inches sq. by 1 inch in thickness, is impregnated with wax just under the surface thereof. The best results have been obtained by impregnating each briquet with approximately 8% by weight of wax. The best wax for this purpose has been found to be a slack wax having a 110° melting point which has been impregnated into the briquet by means of a two-step operation in which the briquets, at a temperature of approximately 150° F. are dipped in the slack wax which is at a temperature of approximately 130° F. The procedure involves dipping the briquet in the molten wax for one second and withdrawing it, allowing the briquet to drain for 5 seconds and then redipping the briquet again for a 1 second period. The two-step wax dipping operation of the hot briquet causes the charcoal to be quenched while the second dip stops the first wax from penetrating further into the briquet.

The best results are obtained when the briquet is impregnated with the wax to a depth of approximately 1/16 inch. The double dipping operation produces two zones of wax impregnation, as illustrated in FIG. 4, with the depth of the zones being exaggerated for purposes of illustration. In FIG. 4 the innermost zone extends to a depth of approximately 1/16 inch, on the average, while a second outermost zone 22 extends to a depth of approximately 1/32 inch, on the average. If the wax extends too deeply into the briquet, the briquet, when ignited, produces too much smoke and by keeping the wax in two shallow zones, just below the surface of the briquet, carburetion of the charcoal is greatly enhanced and expedited.

The slack wax used to impregnate the briquets is an unrefined wax and typically contains 10 % oil. The wax has a melting point of 110° F. and in the dipping operation is heated to 130° F. By heating the briquets to 150° F. prior to the dipping operation, the pores of the briquets are opened, making them more receptive to impregnation by the wax. When the briquets are dipped in the wax, the cooler wax quenches the briquet and the first dip results in the wax migrating into the briquet approximately 1/16 inch, which is deep enough to leave the surface of the briquet clear and the pores still open. It is desirable to keep the pores of the charcoal open at the surface in order to allow the charcoal to carburet when burning and for the impregnated wax to gasify. On the first dipping of the briquet in the wax, the briquet temperature is brought down to about the temperature of the wax, namely, 130°. In the second dipping of the briquet, the wax impregnates to a depth of approximately 1/32 inch.

The dipping operations are kept short since, if allowed to reside too long in the wax, the wax would penetrate too deeply into the briquet, which would result in poor burning characteristics. It is desirable to hold the wax just under the surface of the briquet so that the wax will turn into gas when burned. The second dipping operation stops the wax from the first dipping operation from penetrating further into the charcoal.

In practice, the charcoal is heated prior to the dipping operation to a temperature within the range of 150° to 200° F. If the briquets were cold when dipped into the hot wax, the wax would merely coat the outer surface of the briquet, making the briquet much harder to light as compared to an impregnated briquet, as described herein. The impregnated briquet, according to the invention, thus has two zones of wax just under the surface of the briquet, while the outer surface is characterized by a very thin film of wax which is barely visible to the eye and slightly sensible to the touch.

The impregnated briquets resist moisture absorption and reduce charcoal dusting. The presence of the wax within the briquet provides a low-temperature, volatile material stored inside the briquet and flames from the pad start the wax to volatilize, thereby, enhancing the burning action. The wax will not evaporate and may be stored for long periods of time in bags which need not be air tight.

Referring now to FIG. 5 of the drawings, there is illustrated a system for automatically producing, on a continuous basis, impregnated charcoal briquts according to the invention. In FIG. 1 a conveyor 24 carries the briquets 10 from a feeder 26 onto the upper reach of the conveyor. The briquets are first carried through a heating unit 28 which heats the briquets to a temperature in the range of 150° to 200° F. From the heater 28 the briquets are carried under a first wax dispenser 30, which delivers a curtain of molten wax at a temperature of approximately 130° F. over the briquets. To enhance the interaction between the briquets and the wax, a vibratory unit 32 may be located below the wax dispenser 30. The briquets are then carried under a cooling fan 34 and then past a second wax dispenser 36 to provide the second impregnating step. Another vibratory unit 38 may be provided under the conveyor and the briquets are then carried past a second fan 40 to cool the briquets which are then transferred to a bin 42 for storage or packaging.

Referring now to FIG. 6 of the drawings, there is illustrated an individual starting pad 12 made according to the invention. The pad 12 preferably is fabricated from a cellulosic material, such as paper, and preferably is of a non-woven paper material, preferably somewhat soft and bulky to have good absorption characteristics. Paper toweling is ideally suited for this purpose. While the pads may be made up in various sizes, a pad approximately 11 inches square is suitable for most purposes. In any event, the pad 12 is selectively coated with a wax in a pattern illustrated in FIG. 6. Preferably, the wax employed is a relatively high meltingpoint wax and for this purpose a petrolatum wax is preferred. A petrolatum wax having a melting point of about 135° F. provides satisfactory results, although a wax having a melting point on the order of 175° to 185° F. may also be used to advantage. By using a relatively high melting point wax on the pads, the pads will not stick together in the event that packages containing a number of pads are shipped or stored under high temperature conditions.

The pad, as shown in FIG. 6, is formed with an uncoated center portion 44, which may be perhaps 6 inches square. Surrounding the uncoated center portion 44 is a band 46 of relatively thick wax, perhaps 1 inch wide, and between the outer edge of the band 46 and the edge of the pad 12 is a second band 48 of relatively thin wax coating. The corners 16 of the pad are uncoated or with a very thin coating to facilitate the ignition of the pad by means of a match, lighter, or the like. By leaving the center portion 44 free of any wax, or only lightly coated, and piling the charcoal within the coated area 44, very little smoking results, which would not be the case if the pad were fully coated with a thick layer of wax.

When the pad is ignited at a corner, the fire immediately speads all around the outer edge of the pad and the thinly coated edges of the pad form a fire lane or path about which the flames spread. As the outer edge of the pad ignites it works its way inwardly, igniting the band 46 with a stronger, more durable flame and all sides of the pile of briquets will be heated uniformly at the same time, greatly enhancing the ignition of the briquets. The heavy wax supports a flame that will resist wind or rain and will furnish enough flame to start the treated charcoal. In order to further enhance the burning action of the pad, particularly around the edges, the margins of the pad may be formed with shallow corrugations 50 which serve to vent the pad, allowing air to circulate freely and ensure optimum burning action.

Referring now to FIG. 7 of the drawings, there is illustrated a modification of the pad, and in this embodiment a pad 12', similar to that of the pad of FIG. 6, is formed with a transverse medial tear line 52, extending along the center of a band 54 of a relatively light coating of wax also extending transversely of the pad. The FIG. 7 pad may be torn in half along the tear line, allowing one-half to be used for relatively small fires, or for starting in small grills, or the like.

Having thus described the invention, what we claim and desire to obtain by Letters Patent of the United States is:

1. A charcoal briquet system comprising in combination a. a quantity of charcoal briquets, and b. a pad of easily ignitable material of a size sufficient to pile a number of briquets thereon, c. said pad being formed of a soft, thin, flexible cellulosic material at least partially coated with wax and conformable to the contour of a pile of said briquets.

2. A system according to claim 1 wherein each of said briquets is impregnated with wax in a zone directly below the surface of said briquet.

3. A system according to claim 1 wherein each of said briquets is impregnated with two zones of wax directly below the suface of said briquet, the surface of said briquet being substantially wax free.

4. A system according to claim 1 wherein said pad is coated with wax about the margins thereof, the center portion and corners of said pad being substantially wax free.

5. A system according to claim 4 wherein the outer margins of said pad are thinly coated with wax and a band inwardly of said outer margins is thickly coated with wax.

6. A system according to claim 4 wherein the edges of said pad are corrugated.

7. A system according to claim 1 wherein said wax has a relatively high melting point.

8. A system according to claim 4 wherein said pad is formed with a medial transverse tear line and coated with a band of wax on both sides of said tear line.

* * * * *